US009435146B2

(12) United States Patent
Müller et al.

(10) Patent No.: US 9,435,146 B2
(45) Date of Patent: Sep. 6, 2016

(54) SAFETY DOOR HANDLE

(75) Inventors: Dirk Müller, Essen (DE); Michael Kalesse, Ratingen (DE); Ralf Lennhoff, Hagen (DE)

(73) Assignee: HUF HULSBECK & FURST GMBH & CO. KG, Velbert (DE)

( * ) Notice: Subject to any disclaimer, the term of this patent is extended or adjusted under 35 U.S.C. 154(b) by 873 days.

(21) Appl. No.: 12/948,949

(22) Filed: Nov. 18, 2010

(65) Prior Publication Data

US 2011/0115240 A1 May 19, 2011

(30) Foreign Application Priority Data

Nov. 18, 2009 (DE) ..... 10 2009 053 553

(51) Int. Cl.
*E05B 3/00* (2006.01)
*E05B 85/10* (2014.01)
*E05B 77/06* (2014.01)

(52) U.S. Cl.
CPC ..... *E05B 85/10* (2013.01); *E05B 77/06* (2013.01); *Y10T 29/49863* (2015.01); *Y10T 292/57* (2015.04)

(58) Field of Classification Search
CPC ..... E05B 77/06; E05B 85/10
USPC ..... 292/336.3, DIG. 22, DIG. 61, DIG. 65
See application file for complete search history.

(56) References Cited

U.S. PATENT DOCUMENTS 3,583,741 A * 6/1971 Breitschwerdt et al. ..... 292/216
3,719,248 A * 3/1973 Breitschwerdt et al. ..... 180/271
6,007,122 A * 12/1999 Linder et al. ..... 292/336.3
6,042,159 A * 3/2000 Spitzley et al. ..... 292/216
6,070,923 A * 6/2000 Tanimoto et al. ..... 292/336.3
6,464,270 B1 * 10/2002 Sloan et al. ..... 292/336.3
6,648,382 B1 * 11/2003 Monig et al. ..... 292/336.3
7,029,042 B2 * 4/2006 Belchine, III ..... 292/336.3
7,059,641 B2 * 6/2006 Chanya ..... 292/336.3
7,070,216 B2 * 7/2006 von zur Muehlen ..... 292/336.3
7,303,217 B2 * 12/2007 Savant ..... 292/336.3
7,478,848 B2 * 1/2009 Kim ..... 292/336.3
7,556,296 B2 * 7/2009 Kondo et al. ..... 292/336.3

(Continued)

FOREIGN PATENT DOCUMENTS

CN 101426994 A 5/2009
CN 101449014 A 6/2009

(Continued)

OTHER PUBLICATIONS

Chinese Office Action issued Nov. 22, 2013 re: Chinese Application No. 201010548199.3; citing: U.S. Pat. No. 7,597,368 B2, CN 101426994 A, CN 101449014 A and CN 101519931 A.

*Primary Examiner* — Kristina Fulton
*Assistant Examiner* — Thomas Neubauer
(74) *Attorney, Agent, or Firm* — Cantor Colburn LLP

(57) ABSTRACT

The invention concerns a door handle module for a vehicle with a door handle, which is mounted to move in a support frame for the opening of a door or hatch by a user, the door handle having at least one rest position and one working position, a mechanical coupling unit, through which movement of the door handle from the rest position to the working position can be transferred to a lock, a crash lock, which prevents movement of the door handle and/or coupling unit during the action of an acceleration force, especially during an accident, so that activation of the lock is avoided.

15 Claims, 11 Drawing Sheets

(56) References Cited

U.S. PATENT DOCUMENTS

| | | | | |
|---|---|---|---|---|
| 7,597,368 | B2 | 10/2009 | Savant et al. | |
| 7,819,444 | B2 * | 10/2010 | Kagawa et al. | 292/336.3 |
| 8,167,342 | B2 * | 5/2012 | Bertolotti | 292/336.3 |
| 8,366,159 | B2 * | 2/2013 | Patel | 292/336.3 |
| 8,511,726 | B2 * | 8/2013 | Lennhoff et al. | 292/336.3 |
| 2002/0059693 | A1 * | 5/2002 | Jooss et al. | 16/412 |
| 2008/0277948 | A1 * | 11/2008 | Takaya et al. | 292/336.3 |
| 2009/0102206 | A1 * | 4/2009 | Lee | 292/336.3 |
| 2010/0207404 | A1 * | 8/2010 | Corwin et al. | 292/336.3 |
| 2011/0181058 | A1 * | 7/2011 | Bland | 292/336.3 |

FOREIGN PATENT DOCUMENTS

| | | | |
|---|---|---|---|
| CN | 101519931 | A | 9/2009 |
| DE | 4418317 | A1 | 11/1995 |
| DE | 1694932 | A1 | 8/2006 |
| FR | 2867216 | A1 * | 9/2005 |
| GB | 1324131 | | 7/1973 |
| WO | WO 2005056955 | A1 * | 6/2005 |
| WO | 2006003197 | A1 | 1/2006 |
| WO | 2008068259 | A1 | 6/2008 |
| WO | 2010043573 | A1 | 4/2010 |
| WO | 2010049311 | A1 | 5/2010 |

* cited by examiner

SAFETY DOOR HANDLE

TECHNICAL FIELD

The present invention is directed toward a door handle module for a vehicle with a door handle that is mounted to move in a support frame for the opening of a door or hatch by a user. The invention is also directed toward a method for securing a door handle module with a door handle that can be mounted to move in a support frame for the opening of a door or hatch by a user. The door handle of such a door handle module has at least one rest position and one working position. The door handle module is also equipped with a mechanical coupling unit, through which movement of the door handle from the rest position to the working position can be transferred to a lock, and with a crash lock, which prevents movement of the door handle and/or coupling unit during the action of an acceleration force, especially during an accident, so that activation of the lock is avoided.

BACKGROUND

Document DE 199 29 022 C2 is known from the prior art, which is also directed toward a door handle module, especially a door outer handle, in which a crash lock is also used, which prevents movement of the door handle and/or coupling unit in shape-mated fashion. It is also known from the prior art to provide door handle modules with an inertial mass or a so-called inertial lock, in order to be able to compensate the acceleration forces that act on the door handle during an accident. The crash lock then serves as a fast-acting safety that locks the door handle in shape-mated fashion in its rest position and the inertial lock serves as a slow-acting safety that counteracts the acceleration forces on the door handle.

However, current accident research results have shown that it is precisely during a side impact that alternating acceleration forces can occur, which initiate so-called "fluttering" of the fast-acting crash lock. A maximum acceleration up to 500 g can then act for a brief time on the door handle module, in which the acceleration can reverse its direction of acceleration. The problem therefore arises during actual accidents that the fast-acting crash lock is activated by the acceleration forces acting during an accident and secures the door handle in the rest position, but, during subsequent fluttering of the crash lock, a situation can occur in which the door handle is moved from the rest position by the acting acceleration forces, since the fast-acting crash lock has left its activation position during the fluttering process. Unfortunately, undesired release of the door lock can therefore occur, so that an acute and threatening hazard to the driver is present.

BRIEF SUMMARY

It is therefore the task of the present invention to provide a door handle module and a safety method, in which it is ensured that the door handle during an accident is reliably held in its rest position by a fast-acting crash lock, so that unintended opening of the door lock cannot occur. It is also the task of the present invention to reliably avoid fluttering of the crash lock.

It has already been mentioned here that the features disclosed in the claims and in the description and in the drawings can be essential to the invention by themselves or in combination. Features and details described in conjunction with the method according to the invention then naturally also apply in conjunction with the device according to the invention and vice versa.

The door handle module according to the invention serves for opening of a door, a trunk lid or the like by a user in a vehicle. Ordinarily, a door handle is arranged on an outside of the door for this purpose, the door handle being mounted directly or indirectly to move in a support frame ordinarily arranged on an inside of the door. The door handle itself can assume at least one rest position and one working position, in which movement of the door handle from the rest position to the working position can be transferred to a lock by means of a mechanical coupling unit. The mechanical coupling unit can also be arranged rotatable or pivotable in the support frame of the door handle module and is effectively connected mechanically to the door handle. Movement of the mechanical coupling unit is generally directly or indirectly transferred to the mechanical lock of the door via a transfer element. A crash lock is prescribed according to the invention, which prevents movement of the door handle and/or coupling unit during the action of acceleration force, especially during an accident, so that activation of the lock is avoided. During the action of an acceleration force, i.e., in an accident, the crash lock then activates an additional spring, in which case the additional spring exerts a significant spring force in the form of an additional force on the moving door handle, in order to force the door handle into the rest position or keep it there. Consequently, the present crash lock secures the door handle in force-fit fashion, an additional force being added during activation of the crash lock. This additional force additionally acts on the door handle until the crash lock is deliberately deactivated. It can therefore be ensured that the door handle is not unintentionally transferred from its rest position into the working position during an accident, since the crash lock, once activated, stays in this position, the active position.

The aforementioned problem from the prior art can therefore also be overcome, since fluttering of the crash lock is reliably avoided.

In order for the door handle to be operated in the usual manner in the normal case, the additional force of the additional spring only acts on the door handle module after activation of the crash lock. In the normal case, a return spring ordinarily acts on the door handle, which exerts a permanent restoring force on it, in order to force the door handle into the rest position. This return spring of the door handle also produces a first crash safety, since the acceleration forces must also overcome the already existing restoring force of the return spring, in order to transfer the door handle from its rest position into the working position. However, since the additional spring is engaged by the crash lock during an accident, the required tensile force on the door handle could therefore be significantly increased. The additional force according to the invention can lie between 50 and 200 N or 80 and 120 N.

A significant advantage of the present invention is also seen in the fact that the crash lock can remain activated after being activated once, but the door handle can nevertheless be fully activated, in order to be able to rescue a person in the vehicle without problem even after the accident. For this purpose, it is only required to pull more vigorously on the door handle than normally, in order to also overcome the additional force of the additional spring. The altered activation of the door handle also indicates to a driver of the vehicle that the crash lock has been activated.

In order to be able to adjust the tripping behavior of the crash lock during the action of acceleration forces, an activation spring is provided, which acts exclusively on the crash lock. By appropriate selection of the spring force of the activation spring, the response behavior of the crash lock can therefore be adjusted without problem. By complete separation of the mechanical method of action of the activation spring and the additional spring and the return spring, the desired tripping characteristics of the crash lock and the door module can be set independently of each other without problem for an accident. For this purpose, only the spring force of the corresponding spring must be selected and set or stipulated.

The crash lock can have at least two positions, namely a deactive position, in which the crash lock is deactivated, and an active position, in which the crash lock is activated. It is then conceivable that the crash lock is held in the active position in shape-mated and/or force-fit fashion by a securing element. For this purpose, the securing element for the crash lock can be a switch spring that keeps the crash lock in the active position and/or the deactive position in force-fit fashion. The switch spring here can simultaneously be the activation spring, as further shown in the following text. Optionally, it is conceivable that the securing element is a securing pin, in which case the securing pin itself is spring-loaded and the securing element secures the crash lock in the active position in shape-mated or also force-fit fashion. For this purpose, a snap-in device, especially in the form of a beveled tip can be provided on the securing pin, which cooperates with a mating snap-in device in the crash lock in shape-mated fashion. This mating snap-in device can include an opening or a recess, into which the securing pin of the active position penetrates in shape-mated fashion.

Deactivation of the crash lock now occurs in a simple manner, the securing element being transferred to its normal position, so that the crash lock is transferred from the active position to the deactive position. Deactivation of the crash lock can occur, for example, from the outside (the door handle side) through a small slit or opening in the door or hatch, in which case a corresponding tool must be guided through the opening, in order to force the securing element or crash lock from the active position. However, to achieve increased safety, it is recommended to configure the deactivation of the crash lock exclusively performable from the inside of the door (the support frame side). Here again, only the securing element or the crash lock need be transferred from the active position to the deactive position. The door handle module is then fully ready for use again, the additional force being again switched off, since the crash lock is arranged back in the deactive position. The door handle can therefore be operated quite normally again, i.e., merely against the restoring force of the return spring.

In order to further increase the safety of the door handle module, it can be prescribed that the crash lock has two active positions. The door handle is thus secured against acceleration forces from two different effect directions. For this purpose, the deactive position of the crash lock can be provided between the two active positions, in which case the crash lock is configured rocker-like, which can be transferred from the deactive position into the first or second active position, if an acceleration force acts on the crash lock. It is also conceivable that, instead of the previously mentioned crash lock with an active position, a second crash lock is provided, arranged on the door handle module, so that it trips in the opposite direction to the first crash lock, when an opposite acceleration force (with reference to the first crash lock) acts on the door handle module. The first crash lock can be arranged at or on one end of a pivot of the coupling unit. The second crash lock, on the other hand, can be arranged at or on an opposite end of the pivot of the coupling unit on which the first crash lock can be arranged. It is also conceivable that a shape-mated crash lock, as in the prior art, for example, as disclosed from document DE 199 29 022 C2, is used. This crash lock can be provided as second or as third crash lock in the door handle module according to the invention, in which the first and optionally the second crash lock can represent a switchable shape-mated crash lock. By the use of the shape-mated crash lock, it is ensured that even very high acceleration forces in each case do not lead to activation of the door handle, even if the acceleration forces are much higher than the additional force of the connected additional spring.

In the context of the invention, it can also be prescribed that an actuating element is present, which mechanically cooperates, on the one hand, with the additional spring for the door handle and, on the other hand, with the crash lock in the active position. The actuating element here can be mounted on the support frame or on the mechanical coupling unit. Other embodiments of the crash lock, the securing element and the actuating element are also naturally conceivable in the context of kinematic reversal.

In a special first practical example, the connectable additional spring is arranged between the actuating element and the support frame, and the door handle or coupling unit in the normal case exerts no effect on the actuating element in the deactive position of the crash lock, since a corresponding free space is provided. In the active position, the crash lock is moved into the already mentioned free space, so that the mechanical coupling unit or the door handle must act on the activation unit, since the crash lock is in the way. The actuating element is therefore operated indirectly by the crash lock from the operated door handle or mechanical coupling unit. In this case, the activation unit can be designed pin-like, which is directly connected to the additional spring. A pressure via the crash lock on the actuating element causes compression of the additional spring, configured as a compression spring. Naturally, a kinematic reversal is also conceivable in this variant, in which case the compression spring can be configured as a tension spring or leaf spring or the like. The actuating element can be mounted movable longitudinally.

In a second essential practical example, the additional spring is arranged between the actuating element and mechanical coupling unit, in which case a relative movement is possible between the actuating element and the mechanical coupling unit in the deactive position of the crash lock. By activation of the crash lock in its active position, the actuating element is no longer freely movable, as in the normal case, since the crash lock now restricts the movement of the actuating element. For this purpose, the crash lock has a stop that mechanically cooperates with the actuating element. Activation of the door handle or mechanical coupling unit now causes a relative movement of the actuating element relative to the coupling unit, so that the additional spring is tightened. In this practical example, the actuating element is mounted to rotate or pivot on the mechanical coupling unit, in order to permit a relative movement between the two components in the active position of the crash lock. Through this relative movement, the additional force is exerted on the door handle or the mechanical coupling unit during activation of the crash lock.

In the two practical examples just mentioned, the crash lock is mounted to pivot or rotate on the support frame and has a recess or free space, through which the actuating element in the normal case can be moved without contact. It is also conceivable that the crash lock is mounted on the mechanical coupling unit, if kinematic reversal is present.

It is also conceivable that the additional spring is configured in one piece with the actuating element and therefore represents a combined part that satisfies both functions. The combined part in the first practical example can be configured geometrically equivalent to the actuating element, composed of an elastically deformable material, like rubber or plastic, in order to acquire a flexible or spring effect. The required additional force of the actual additional spring is produced by the elastic deformability. The combined part can then be arranged, especially fastened, on the support frame. The combined part in the second significant practical example can be connected, especially fastened to the coupling unit, in which case the combined part can also be configured elastically deformable here. This combined part can also be a spring element, especially in the form of a leaf spring, leg spring or torsion spring. This spring element can have spring steel, bimetal or plastic. This combined part is therefore also configured flexible so that the additional force can be provided to the additional spring.

The invention is also directed toward a method for securing a door handle module with a door handle, which is mounted to move in a support frame for the opening of a door or hatch by a user. In this case, the door handle has at least one rest position and one working position. A mechanical coupling unit is also provided for the door handle module, through which movement of the door handle from the rest position into the working position can be transferred to a lock. A crash lock is also provided in the door handle module, which prevents movement of the door handle and/or coupling unit during the action of an acceleration force, especially during an accident, so that activation of the lock is avoided. In the method according to the invention, the crash lock is activated during the action of an acceleration force of an additional spring, in which the additional spring exerts a significant spring force in the form of an additional force on the moving door handle and forces it into the rest position. The door handle module according to the invention just described is also suitable for executing the method just mentioned for securing a door handle module.

BRIEF DESCRIPTION OF THE DRAWINGS

Further advantageous embodiments of the invention are apparent from the following description, the claims and the figures. The invention is shown in the figures in two fundamental practical examples. In a schematic, three-dimensional view:

DETAILED DESCRIPTION

Figure 1A:
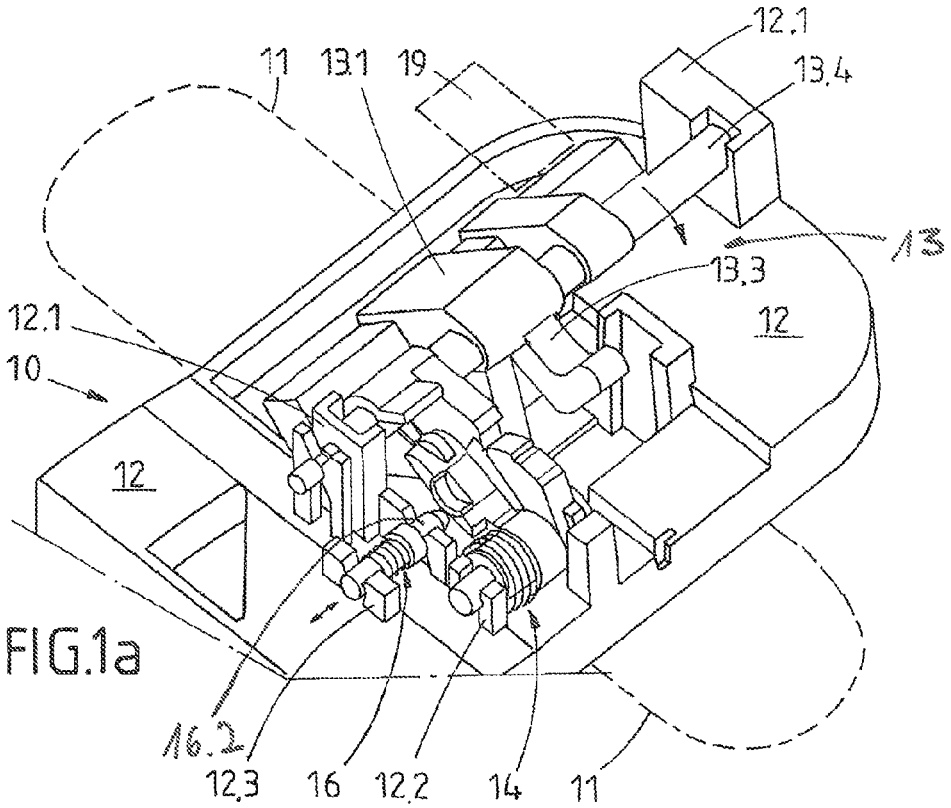
FIG. 1*a* shows an inside view or rear view of a first door handle module according to the invention with a longitudinally movable actuating element.

A first practical example of the door handle model 10 according to the invention for a vehicle is shown in FIG. 1*a*. The inside view or rear view of the door handle module 10 is then shown, in which the door handle 11 itself has been left out. For this reason, the door handle 11 is only indicated with dashed lines in FIG. 1. The door handle 11 cooperates from the outside with a mechanical coupling unit 13, which is mounted to move on the support frame 12 on the inside of the door. The door handle 11 is mounted to move in the support frame 12 or on the coupling unit 13. In order for a lock in the door to be opened with it, movement of the door handle 11 is transferred directly or indirectly to the lock via a mechanical coupling unit 13 through a transfer element.

The door handle module 10 according to the invention is equipped with a crash lock 14, which engages an additional spring 15 during an accident or during the action of acceleration forces. This additional spring 15 acts on the door handle 11 with its spring force and forces the door handle 11 into its rest position Ia. Ordinarily, a return spring 11.1 also acts on the door handle 11, so that it is automatically transferred from its working position Ib into its rest position Ia and stays there. In the present practical example from FIGS. 1*a* to 4, the corresponding return spring 11.1 is not shown. However, in addition to crash lock 14, an inertial lock 13.1 is arranged on mechanical coupling unit 13, which essentially comprises an additional weight. This inertial lock 13.1 generates a counter-force to the acceleration forces acting on the door handle 11 during an accident. The inertial lock 13.1 is therefore supposed to compensate for the acceleration forces on the door handle 1 during the accident.

As is further apparent from FIG. 1*a*, the coupling unit 13 is accommodated to rotate on the support frame 12 in a first bearing 12.1. This bearing 12.1 has a bearing site on the left and right side, in which a rotational axis 13.4 of the coupling unit 13 is held in shape-mated fashion, but rotatable. A receptacle 13.3 for the door handle 11 is also provided on the coupling unit 13, the receptacle 13.3 in the present case including an L-shaped shoulder arranged in the center on the rotational axis 13.4 of the coupling unit 13. A driver 13.5 is also provided on the coupling unit 13. The driver 13.5, the inertial lock 13.1 and the receptacle 13.3 are connected to rotate in unison with each other, especially in one piece, and optionally to the rotation axis 13.4 of the coupling unit 13.

A second bearing 12.2 for a (first) crash lock 14 according to the invention is also provided on the support frame 12, which supports the crash lock 14 rotatably. A third bearing 12.3 for a longitudinally movable securing pin 16.2 is also provided on the support frame 12, the securing pin 16.2 serving as securing element 16 for crash lock 14. A second crash lock 19 is optionally indicated with a dashed line on the back of support frame 12, which can block the mechanical coupling unit 13 in shape-mated fashion. It is also conceivable that this second crash lock 19 (like the first crash lock) acts on the coupling unit 13 in force-fit fashion, but a different direction of effect relative to the first crash lock 14 being present, in order to be able to reliably take up oppositely acting acceleration forces that act on door handle 11.

Figure 1B:
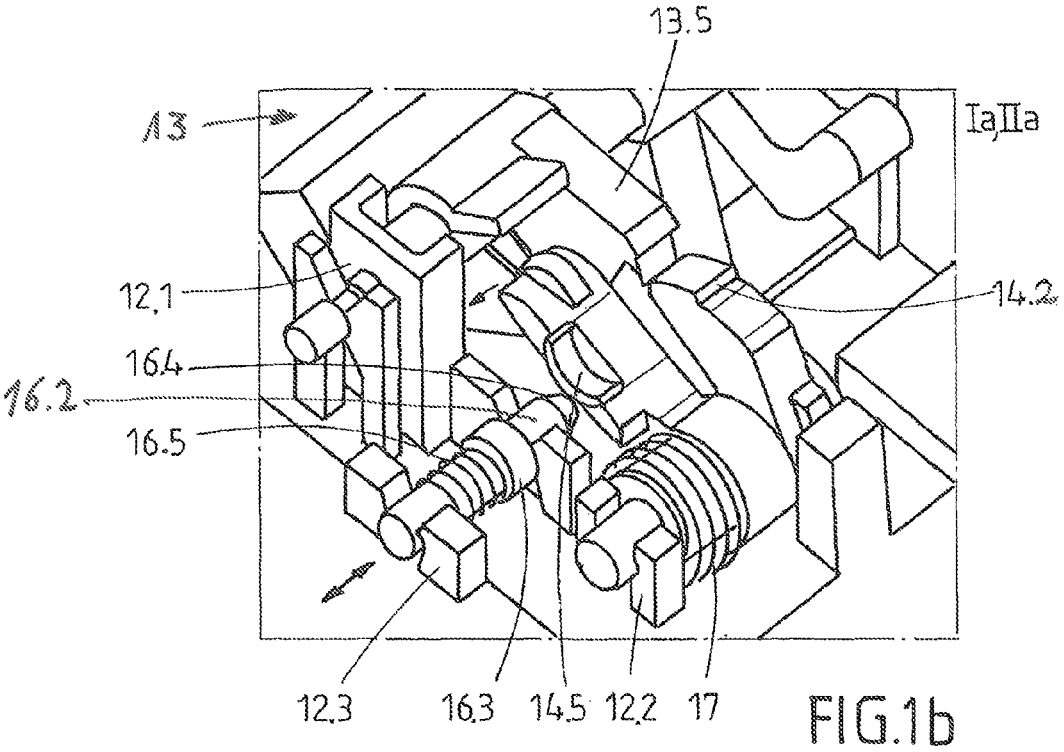
FIG. 1*b* shows an enlargement of a cutout of the crash lock from FIG. 1*a*.

A cutout enlargement from FIG. 1*a* is shown in FIG. 1*b*. The crash lock 14 according to the invention with its two lever-like arms is shown here, which are configured to rotate in unison with each other. The crash lock 14 is mounted to rotate on the support frame 12 on two bearing sites via the second bearing 12.2. For this purpose, the crash lock 14 has a rotational axis 14.4 accommodated in shape-mated fashion in the second bearing 12.2.

The securing pin 16.2 is also apparent in the third bearing 12.3 on support frame 12. This securing pin 16.2 serves as securing element 16 for the crash lock 14. The securing pin 16.2 is held at two locations in the third bearing 12.3, movable longitudinally. A spring 16.5 also acts on securing pin 16.2, the spring 16.5 being arranged between the left bearing site 12.3 (view from FIG. 1*b*) and a shoulder 16.3 of the securing pin 16.2. Spring 16.5 presses the securing pin 16.2 permanently in the direction of crash lock 14. The securing pin 16.2 has a snap-in device 16.4 on its open end, which is configured, in particular as a tip or beveled surface. This snap-in device 16.4 cooperates in the active position 2*b* with crash lock 14, especially the mating snap-in piece 14.5, in shape-mated fashion. If an acceleration force acts on crash lock 14, it is moved in the direction of the inside (i.e., counterclockwise), in which case the crash lock 14 shifts the securing pin 16.2 against spring 16.5 longitudinally, the mating snap-in device 14.5 sliding along the beveled tip of snap-in device 16.4, in order to move the securing pin 16.2. As soon as the crash lock pin 14 has completely passed the snap-in device 16.4 with mating snap-in device 14.5, the securing pin 16.2 (forced by spring 16.5) goes back to its original position. The crash lock 14 is therefore now held in shape-mated fashion by the cooperation of snap-in device 16.4 with the mating snap-in device 14.5 in active position 2*b*. The crash lock 14 can be rotated further clockwise around rotational axis 14.4, but it can no longer leave its active position 2*b* to reach the deactive position 2*a*. This is only possible, if the securing pin 16.2 eliminates shape-mating with crash lock 14. For this purpose, the securing pin 16.2 must be manually and deliberately shifted again against the spring force 16.5.

Figure 2:
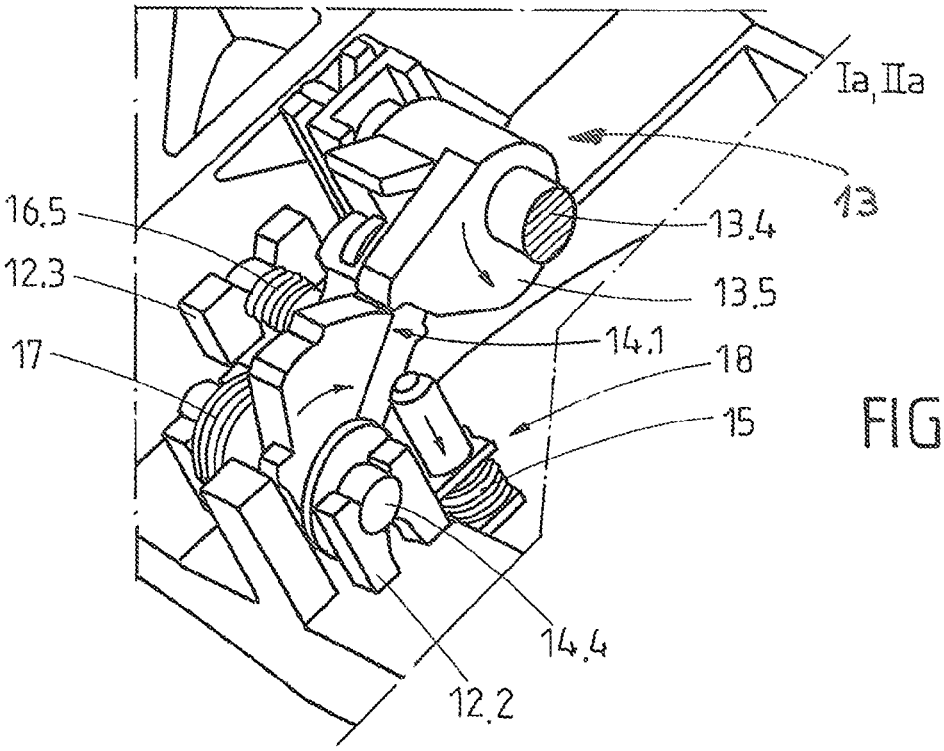
FIG. 2 shows the door handle module from FIG. 1 in the rest position of the door handle and deactive position of the crash lock.
Figure 3:
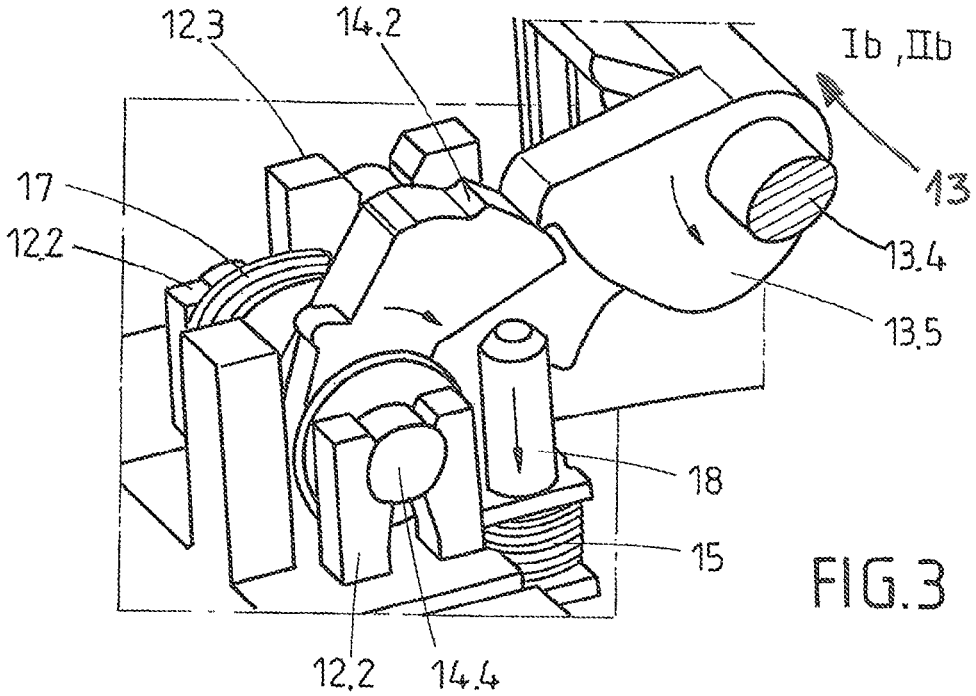
FIG. 3 shows the door handle module from FIG. 2 in the intermediate position of the crash lock and the rest position of the door handle.
Figure 4:
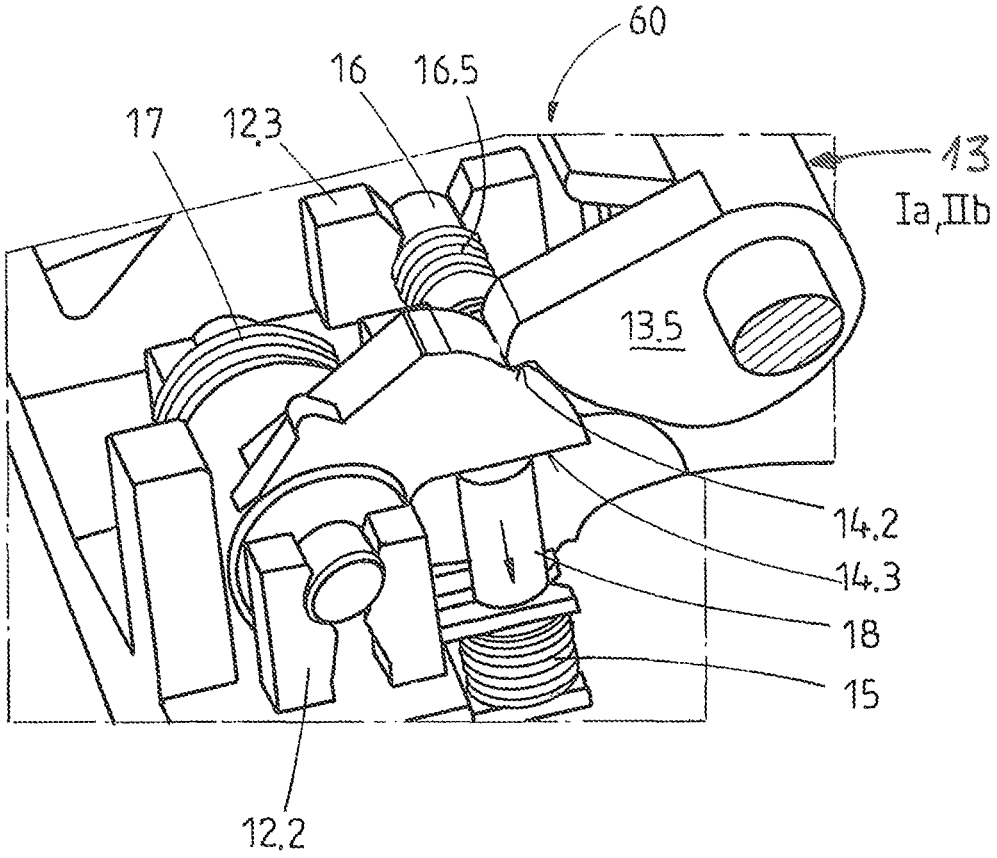
FIG. 4 shows the door handle module from FIGS. 2 and 3 in the active position of the crash lock and in the intermediate or working position of the door handle.

Further function of the door handle module 10 according to the invention from FIGS. 1*a* and 1*b* is apparent from the additional FIGS. 2 to 4. In FIG. 2, in a different perspective, the crash lock 14 and part of the coupling unit 13 are shown, especially with a driver 13.5.

For better overview, the coupling unit 13 was partially blocked out. The crash lock 14 in FIG. 2 is shown again in the deactive position IIa and the door handle in the rest position. The corresponding movement directions of crash lock 14 and coupling unit 13 are indicated by the arrows on the corresponding components. As can now be seen, the coupling unit 13 in the normal case is freely mounted. The driver 13.5 is then moved under the right lever-like arm of crash lock 14, for which a corresponding free space 14.1 is provided. It should be explained here that the two lever-like arms of the crash lock 14 are configured in one piece. The crash lock 14 can be configured as a circular disk segment. In the present case, however, a particularly light variant for the crash element 14 was chosen, in order to keep the inertial forces as low as possible, so that the crash element 14 can get ahead of door handle 11 as quickly as possible during the action of acceleration forces.

In FIG. 3, the door handle 11 and the mechanical coupling unit 13 are again situated in the rest position Ia, whereas the crash lock 14 is in an intermediate position between deactive position IIa and active position IIb. The action of an acceleration force on the crash lock 14 at this instant is indicated. As is apparent, the crash lock 14 is now rotated clockwise around rotational axis 14.4 (from the view of FIG. 3). It is also readily apparent in FIG. 3 that the crash lock 14 is held in the second bearing 12.2 on the support frame 12 to the left and right side of its rotational axis 14.4. In the depicted intermediate position of crash lock 14, the crash lock 14 blocks rotational movement of coupling unit 13, since the driver 13.5 was stopped on the right arm of the crash lock 14. The free space 14.1 is therefore no longer present.

In FIG. 4, the crash lock 14 is now shown in the active position IIb. The door handle 11 has an intermediate position between its rest position Ia and its working position Ib. The driver 13.5 then cooperates in shape-mated fashion with a first stop 14.2 of the crash lock 14, especially the right arm. The crash lock 14 also simultaneously presses, especially with the second stop 14.3, on the actuating element 18, which is held longitudinally moveable in support frame 12. This actuating element 18 is designed pin-like and cooperates with the additional spring 15. The additional spring 15 is therefore compressed, when the driver 13.5 presses farther counterclockwise on crash lock 14. The crash lock 14 then rotates clockwise around rotational axis 14.4 and therefore forces the actuating element 18 against additional spring 15. The connected tension spring 15 therefore increases the required tensile force on door handle 11, in order to be able to open the lock in the door. It is also apparent that after a single activation of crash lock 14, the connected additional spring 15 acts on the door handle 11, until the crash lock 14 is deactivated. Deactivation by the securing pin 16.2 was already described above. The activation spring 17 then moves the crash lock 14 into its deactive position IIa. By changing the spring force of activation spring 17, activation of the crash lock 14 can also be set without problem. It is also apparent that the activation spring 17 is not in any mechanical interaction with the additional spring 15 of the return spring 11.1. The door handle module 10 according to the invention can then be arbitrarily and simply adjusted by corresponding selection and adjustment of the spring forces for the springs 11.1, 15, 17, mentioned above.

The first practical example of the door handle module 10 according to the invention is shown in FIGS. 1 to 4 with two separate parts in terms of design, namely the additional spring 15 and the actuating element 18. However, as described previously in the text, a combined part 20 that assumes the functions of the two components 15 and 18 can be used instead of the two components 15, 18. For this purpose, the actuating element 18 depicted in detail in FIG. 4 can be fastened to the support frame 12 and also have the same or similar geometry, as shown. However, full relative movement of the actuating element 18 relative to support frame 12 is not possible now, since the comparable combined part 20 is configured elastically deformable and the therefore supplies the spring force to additional spring 15 by elastic deformation. Consequently, the additional spring 15 can be dispensed with in a fixed actuating element 18 having elastic properties and a one-part combined part 20 is at issue.

Figure 5A:
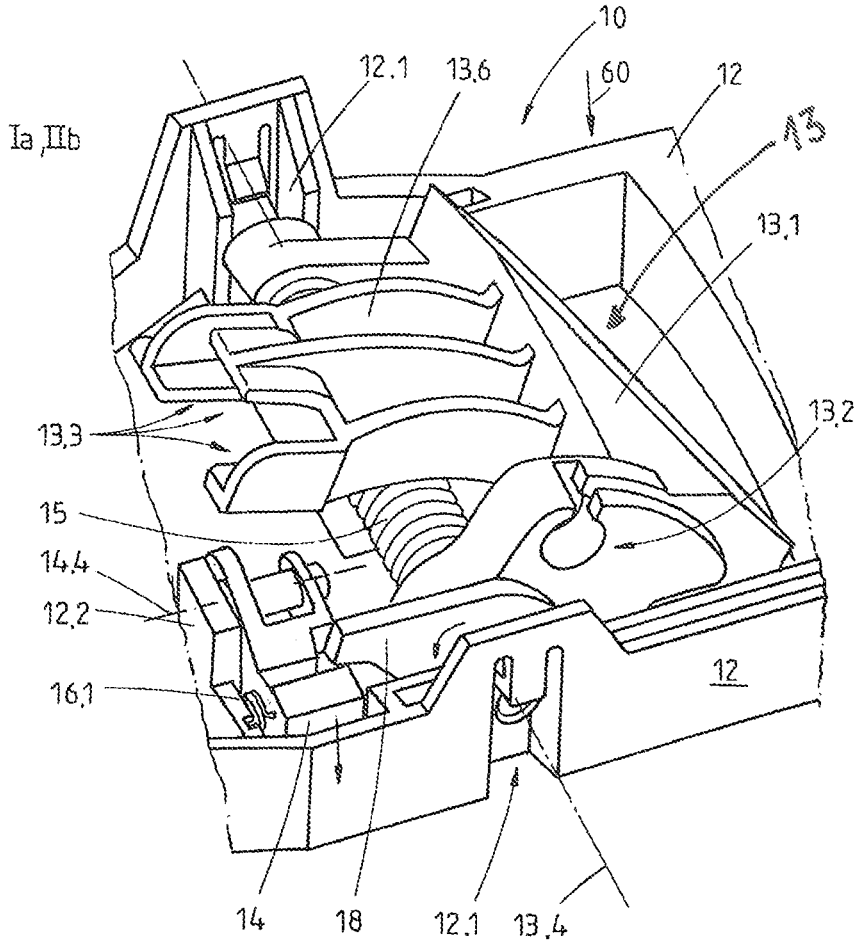
FIG. 5*a* shows an inside view or a rear view of an additional door handle module according to the invention with an actuating element mounted to pivot or rotate.
Figure 9:
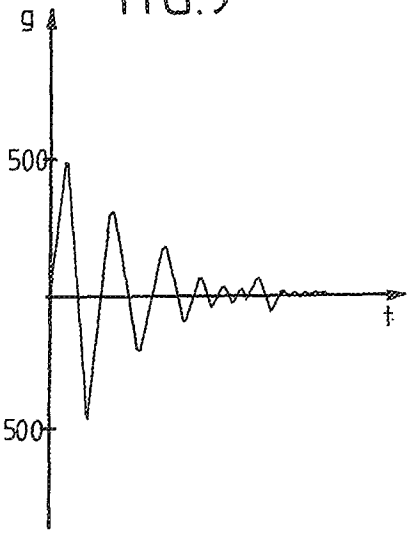
FIG. 8*b* shows the crash lock from FIG. 8 in the active position and FIG. 9 shows a schematic view of an acceleration acting on the door handle model during an accident.

Another practical example of the door handle module 10 is shown in a schematic three-dimensional view in FIGS. 5*a* to 12, except for FIG. 9. In FIG. 5*a*, the inside view or rear view of the door handle module 10 according to the invention with the support frame 12 and the coupling unit 13 is shown. The door handle 11 is mounted movable via the coupling unit 13 on the support frame 12. For this purpose, the coupling unit 13 has a receptacle 13.3. This receptacle 13.3 is connected via three reinforcement ribs 13.6 to the additional coupling unit 13. The reinforcement ribs 13.6 serve for weight-saving configuration of the coupling unit 13 in this area, so that a prescribed inertial lock 13.1 can have the lowest possible weight, which is arranged on an opposite side of the receptacle 13.3 from rotational axis 13.4. The coupling unit 13 is mounted to rotate via the rotational axis 13.4 in a first bearing 12.1 of the support frame 12. The bearing sites 12.1 on the left and right side are provided with corresponding reference numbers in FIG. 5*a*.

A second bearing 12.2 for the crash lock 14 is also provided on support frame 12. The crash lock 14 is then mounted to rotate itself, the rotational axis 14.4 serving to hold the crash lock 14 in the second bearing 12.2. The crash lock 14 is configured essentially as a lever element in this practical example. A securing element 16 in the form of a switching spring 16.1 is arranged on the free end of the lever-like crash lock 14. The method of function of switching spring 16.1 is further explained in FIGS. 8*a* and 8*b*. Activation of the door handle 11 from its rest position Ia into its working position Ib causes a rotation of coupling unit 13 counterclockwise around rotational axis 13.4 (from the view of FIG. 5*a*).

Figure 5B:
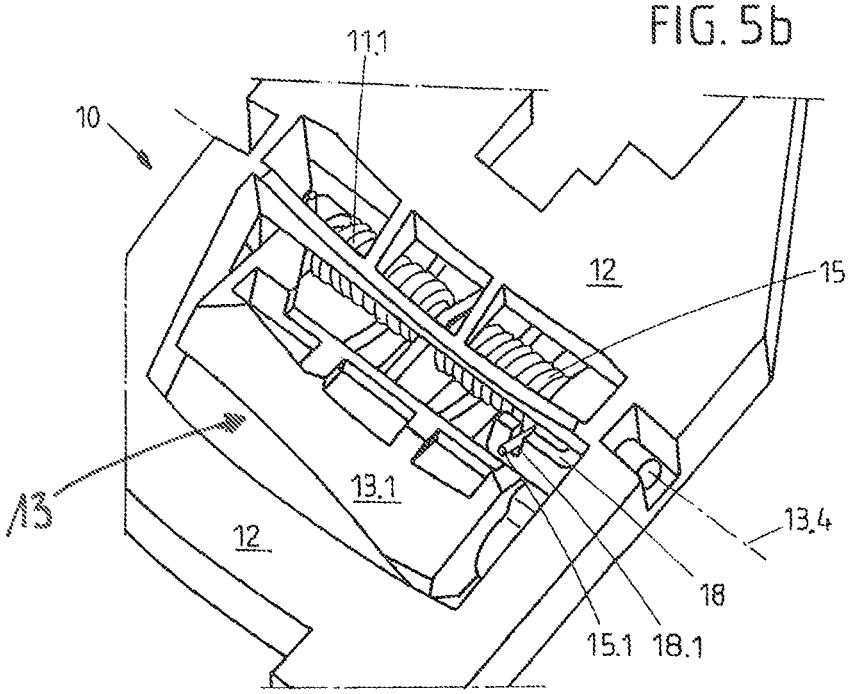
FIG. 5*b* shows a top view of the door handle module from FIG. 5*a* without the door handle and door.

The door handle module 10 from FIG. 5*a* is shown in FIG. 5*b*, in which here a front view is shown without the door handle 11 and the door. The depicted surface of the support frame 12 is normally aligned toward the door. The two tension springs for the door handle 11 are clearly apparent in FIG. 5. This involves the return spring 11.1, which is arranged mechanically active between the support frame 12 and the coupling unit 13, and the additional spring 15, which is provided mechanically active between the coupling unit 13 and the actuating element 18.

Figure 5C:
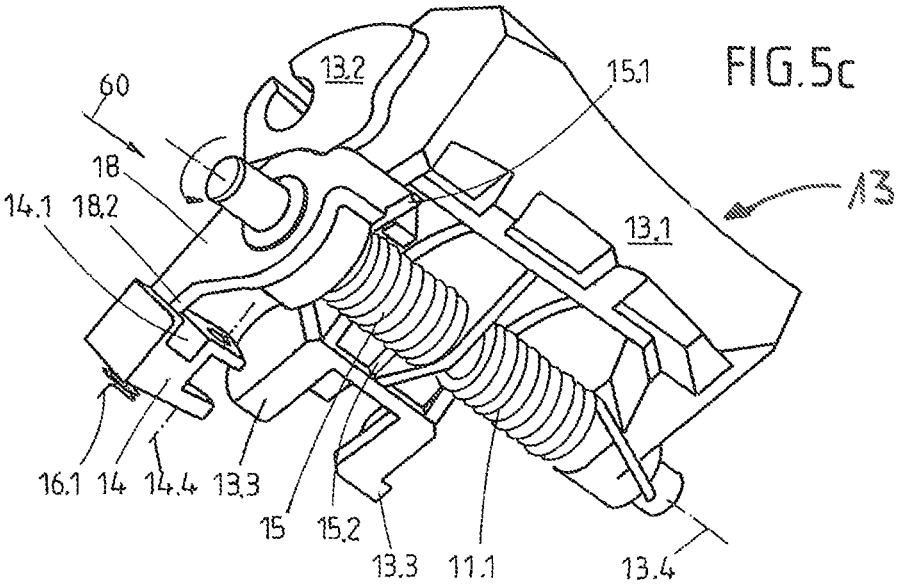
FIG. 5*c* shows a similar view as in FIG. 5*b* of the door handle module, but additionally without the support frame.

For better overview, the support frame 12 was omitted in FIG. 5*c*. It is clearly apparent here that spring 15, with its first end 15.1, cooperates in shape-mated fashion with a recess 18.1 on the actuating element 18. With its second end 15.2, the additional spring 15 contacts the coupling unit 13. Since a relative movement between the coupling unit 13 and the actuating element 18 does not occur in the normal case, the additional spring 15 is also inactive. Consequently, only the return spring 11.1 will act on door handle 11, in order to move it or keep it in its rest position Ia. The actuating element 18 is rotatable around rotational axis 13.4 of coupling unit 13, in which case it is forced into its initial position by the additional spring 15.

In the following FIGS. 6*a* to 7*c*, the method of function of crash lock 14 and connection of the additional spring 15 is explained, a depiction of the support frame 12 being dispensed with for better view.

Figure 6A:
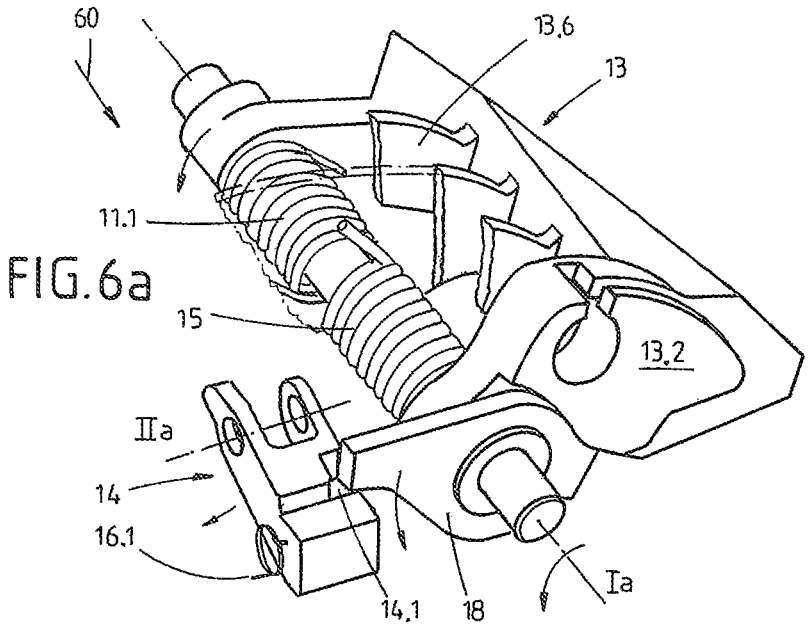
FIG. 6*a* shows a rear view of the door handle module from FIG. 5 without the door frame and in the rest position of the door handle and in the deactive position of the crash lock.

The crash lock 14 is situated in FIG. 6*a* in its deactive position IIa and the door handle 11 in its rest position Ia. If door handle 11 is not pulled, the entire coupling unit 13 is rotated counterclockwise with its shoulder 13.2 for a transfer element to the lock. In the present case, the shoulder 13.2 is equipped for a Bowden cable as a transmission element, for which purpose the circular recess in shoulder 13.2 is provided. The actuating element 18 naturally follows the counterclockwise rotational movement of coupling unit 13.

Figure 6B:
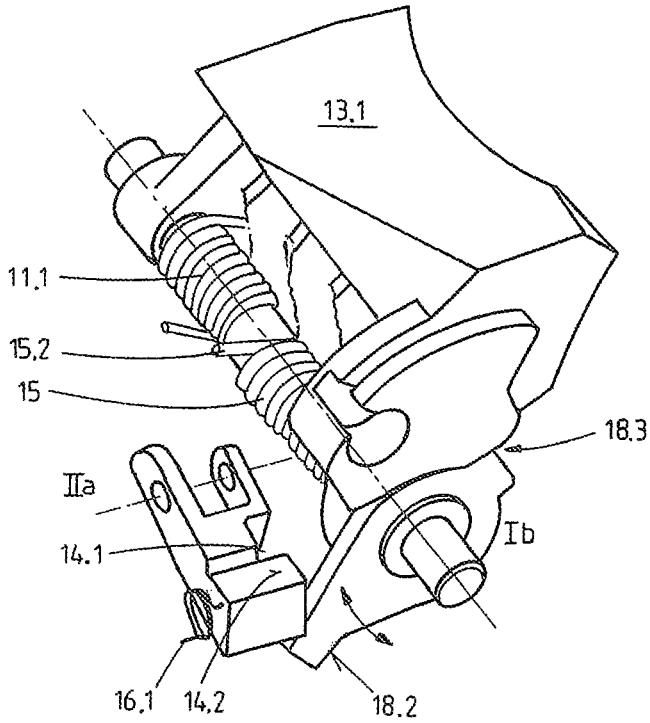
FIG. 6*b* shows the comparable door handle module from FIG. 6*a*, but in the working position of the door handle and in the deactive position of the crash lock.

The door handle 11 and the coupling unit 13 are now shown in FIG. 6*b* in the working position Ia. The crash lock 14 is still situated in the deactive position IIa, so that the normal method of function of the door handle module 10 can be explained. As is apparent from FIG. 6*b*, during rotational movement of the coupling unit 13, the actuating element 18 has been moved by the recess 14.1 in the crash lock 14. Through this recess 14.1, the actuating element 18 is guided during movement of the door handle 11 between the rest position Ia and the working position Ib without contact.

Figure 7A:
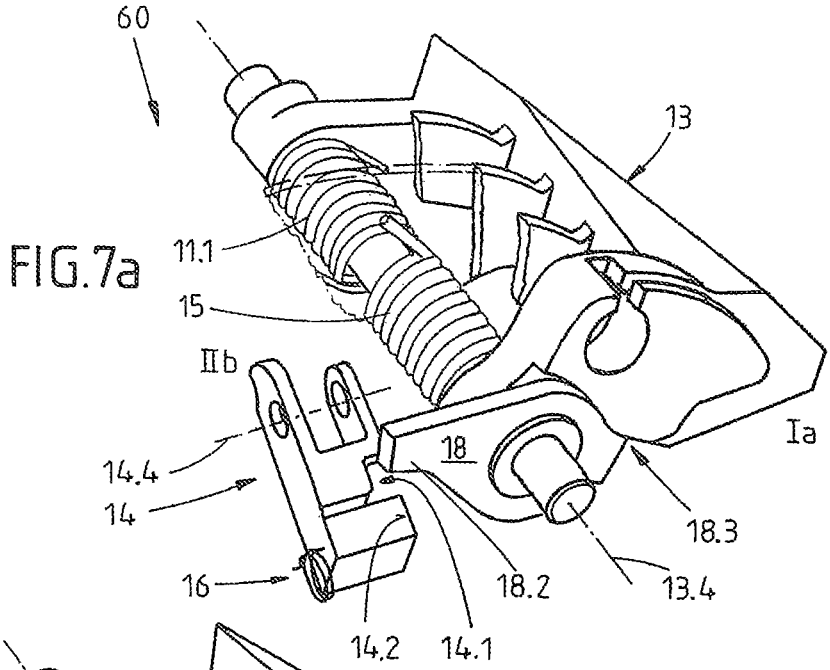
FIG. 7*a* shows the door handle module from FIGS. 5 and 6, but in the active position of the crash lock and in the rest position of the door handle.
Figure 7B:
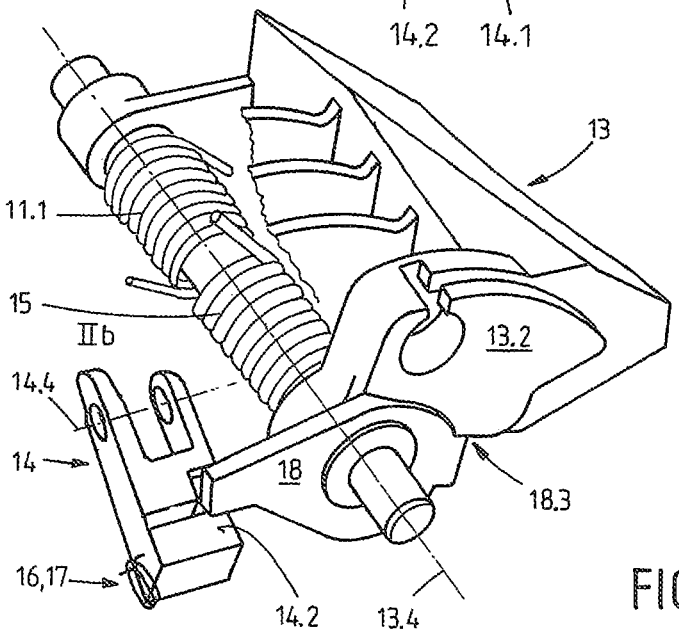
FIG. 7*b* shows the door handle module from FIG. 7*a* in the active position of the crash lock and in the intermediate position of the door handle.
Figure 7C:
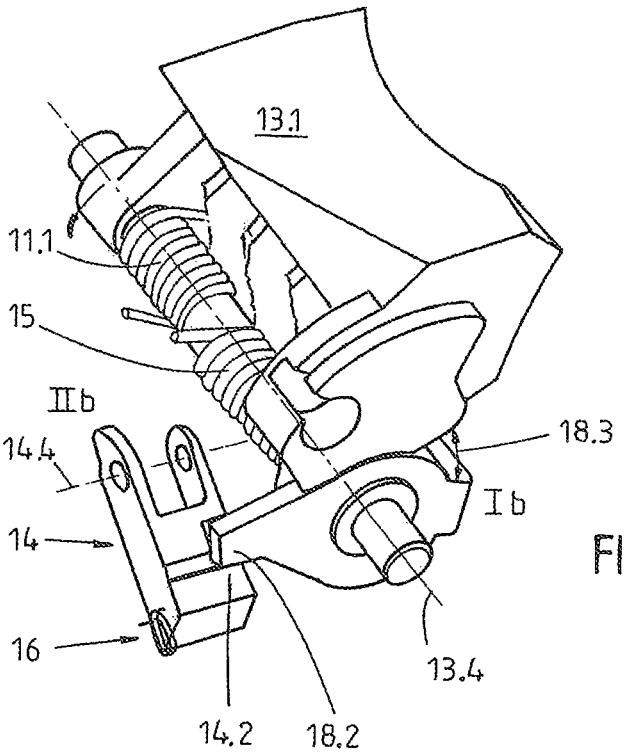
FIG. 7*c* shows the door handle module from FIGS. 7*a* and *b* in the active position of the crash lock and in the working position of the door handle.

The crash lock 14 is situated in FIG. 7*a* after activation in active position IIb and the door handle 11 is still in rest position Ia. If the coupling unit 13 is now rotated by the acceleration forces 60, which act on the door handle 11 counterclockwise around rotational axis 13.4, the actuating element 18 encounters its stop 18.2 on the first stop 14.2 of the crash lock 14. The actuating element 18 therefore can no longer slide through or past the crash lock 14 without contact. In FIG. 7*b*, an intermediate position of the door handle between rest position Ia and working position Ib is shown. At this moment, the actuating element 18 encounters the crash lock 14. Until this moment, no relative movement occurs between the actuating element 18 and the coupling unit 13, which is apparent by the lack of a gap 18.3 between the two components 13, 18. At this instant, the spring force of additional spring 15 begins to act on the door handle 11 via coupling unit 13. The relative movement between actuating element 18 and coupling unit 13 through the resulting gap 18.3 is now visible in FIG. 7*c*. In this case, the coupling unit 13 has been rotated farther counterclockwise around rotational axis 13.4, in which the actuating element 18 can no longer follow this rotational movement, since it is held in shape-mated fashion by the first stop 14.2 of the crash lock 14. The door handle 11 must therefore also be moved against the spring force of additional spring 15, which acts between the actuating element 18 and the coupling unit 13. The force of the return spring 11.1 naturally also still acts on door handle 11. Ordinarily, the force of the additional spring 15 is dimensioned, so that the acceleration forces that act on the door handle 11 during an accident are lower. Nevertheless, functioning of the door handle module 10 is also fully retained after activation of crash lock 14, but the force of the additional spring 15 must be overcome during activation of door handle 11 with the normal restoring force of return spring 11.1, in order to operate the lock. If the door handle 11 is now transferred back by the spring forces from its working position Ib into the rest position Ia, the gap 18.3 between actuating element 18 and the coupling unit 13 is eliminated. However, the switching spring 16.1 also holds the crash lock 14 in its activation position IIb, so that the crash lock 14 must first be deactivated, in order to switch off the spring force of the additional spring 15.

Figure 8B:
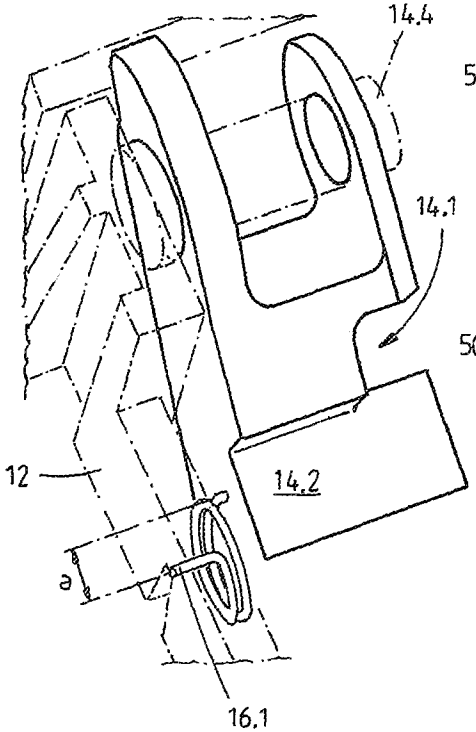
Figure 8A:
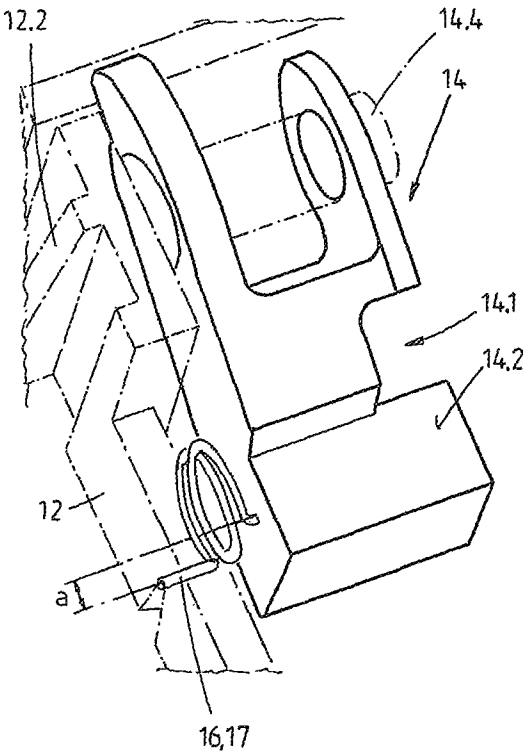
FIG. 8*a* shows an enlargement of a cutout around the crash lock from FIGS. 5 to 7 in the deactive position.

It is apparent in FIG. 8*a* that the switching spring 16.1 engages in shape-mated fashion on the free end of the lever-like crash lock 14. For this purpose, one end of the coil switch spring 16.1 cooperates in shape-mated fashion with a hole in the crash lock 14. The other end of the coil switch spring 16.1 cooperates in shape-mated fashion with a recess in support frame 12. The spring force of the switch spring 16.1 therefore always acts on the crash lock 14. This switch spring 16.1 simultaneously serves as activation spring 17, so that the tripping moment of the crash lock 14 can be established for activation. The crash lock 14 is shown in FIG. 8*a* in its deactive position IIa. The switch spring 16.1 then forces the crash lock 14 into the deactive position IIa. If the crash lock 14 is now forced into the active position IIb against the spring force of switch spring 16.1 by the acceleration forces acting during an accident, the switch spring 16.1 now also keeps the crash lock 14 in active position IIb. As indicated by the distance a between the two ends of the switch spring 16.1, the switch spring 16.1 has two stable positions obtained from the special geometric arrangement of the two fastening points for the ends of the switch spring 16.1. As already mentioned, the crash lock 14 is held by the switch spring 16.1, both in its deactive position IIa and in its active position IIb. It should also be mentioned here that instead of switch spring 16.1, the already described securing pin 16.2 can also be provided as securing element 16 for crash lock 14.

Numerous kinematic reversals in the door handle module 10 according to the invention are certainly also conceivable.

For example, in FIG. 9, the acceleration acting during an accident on a vehicle and the door handle module 10 is shown in time-dependent fashion in a coordinate system. It is then apparent, on the one hand, that the acceleration can reach very high brief peak values. A change in direction of acceleration can also occur over time. The decay behavior of acceleration is also clearly apparent. Through this alternating acceleration, fluttering of the crash lock described in the prior art can occur.

Figure 10:
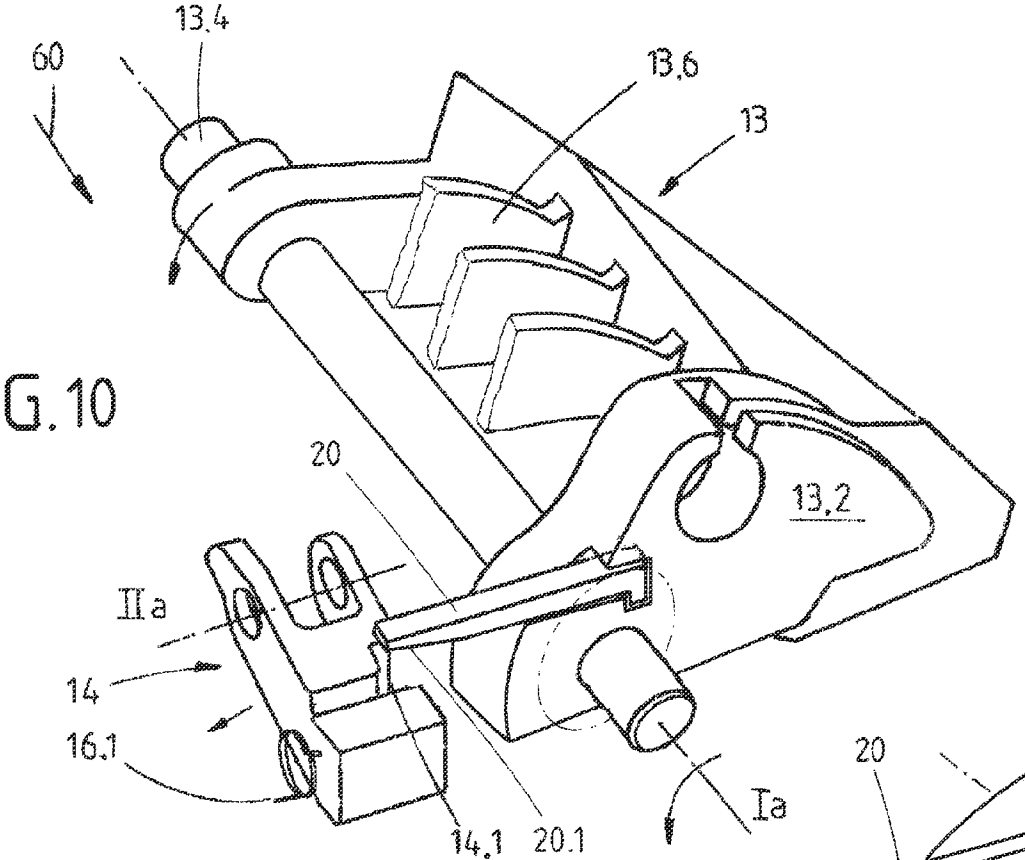
FIG. 10 shows a rear view of a comparable door handle module from FIG. 6*a* with a combined part in the rest position of the door handle and in the deactive position of the crash lock.

A practical example comparable to FIGS. 5*a* to 8*b* is shown in the additional FIG. 10, in which a combined part is used here, which replaces the two components 15 and 18. For better overview the return spring 11.1 is not shown in FIG. 10. In particular, the combined part 20 has a nail-like or web-like geometry and itself composed of an elastic material, like spring steel, plastic or the like. In order to fasten combined part 20 to the coupling unit 13 it can have a receptacle into which the combined part 20 can be shape-mated. With its protruding and free end 20.1 the combined part 20 cooperates mechanically with the crash lock 14 during an emergency, as was already described in FIGS. 5*a* to 8*b* for actuating part 18. However, in the present case the elastic deformation of combined part 20 in FIG. 10 produces the required additional force for the original additional spring 15. To simplify assembly of combined part 20 on the coupling unit 13 a clip connection can be provided, through which the combined part 20 can be fastened to coupling unit 13. The combined part 20 can also be secured in the receptacle by a washer or lock washer, shown in FIG. 10, which lies around pivot 13.4.

Figure 11:
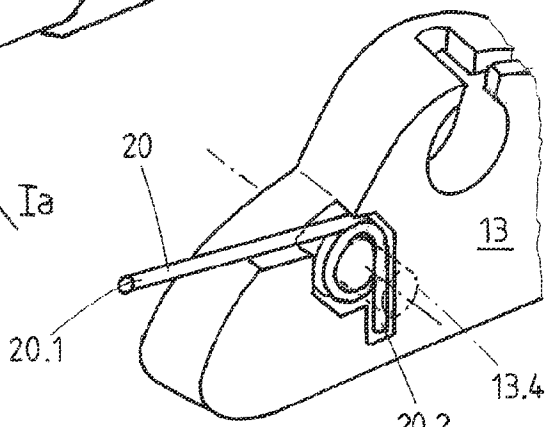
FIG. 11 shows a detail view from FIG. 10 with another combined part and FIG. 12 shows a detail view of another door handle module similar to FIG. 10, but with support frame 12.

A variant for combined part 20 from FIG. 10 is shown in detail in the additional FIG. 11. A leg spring, wire spring or torsion spring is used here instead of the nail-like or web-like combined part 20. This combined part 20 can be fixed in coupling unit 13 via a receptacle, the fixed end 20.2 being arranged in the receptacle. It is therefore ensured that the combined part 20 retraces the rotational movement of coupling unit 13. A free end 20.1 or an arm of the coupling unit 13, which mechanically cooperates with the crash lock 14 in the active position 2*b*, also protrudes in the depicted combined part 20. This combined part 20 also produced the additional force for additional spring 15 by elastic deformation.

Figure 12:
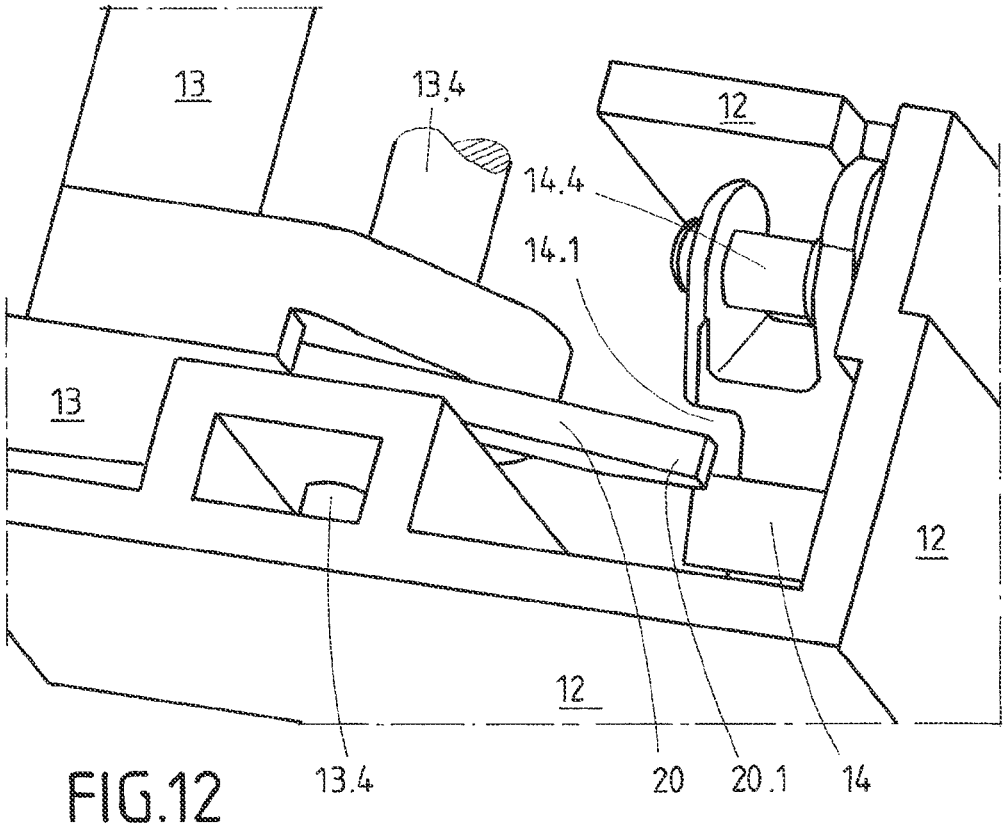

It is apparent from the additional FIG. 12 how the combined part 20 can be fastened to the coupling unit 13. The combined part 20 accommodated shape-mated or press-fit in a receptacle of the coupling unit 13 so that it is mechanically secured there. The support frame 12 can also ensure that the combined part 20 securely stays in its receptacle in the coupling unit 13 by almost closing off the receptacle at least in areas. Simple mounting of combined part 20 on the coupling unit 13 is therefore possible, since it need only be placed in the corresponding receptacle. By additional mounting of coupling unit 13 on support frame 12 the combined part 20 is then securely held in the assembled state. The combined part 20 can naturally also be screwed, welded, riveted, glued or otherwise firmly joined to coupling unit 12 even without a corresponding receptacle in the coupling unit 13. Since the function of the combined part 20 does not differ from the function of the original actuating unit 18 in conjunction with crash lock 14, the preceding text is referred to in this respect.

The invention claimed is:

1. A door handle module for a vehicle, comprising:

a door handle, movably mounted in a support frame for the opening of a door or hatch by a user, the door handle having at least one rest position and one working position, a mechanical coupling unit, through which a movement of the door handle from the rest position to the working position can be transferred to a lock, a crash lock, which prevents movement of the door handle and/or coupling unit during action of an acceleration force, so that activation of the lock is avoided, a securing element, and an additional spring;

wherein the crash lock activates the additional spring by cooperating with the securing element during the action of the acceleration force, in which case the additional spring exerts a spring force in the form of an additional force on moving door handle, in order to force the door handle into the at least one rest position, wherein the crash lock remains activated after a first activation, and the door handle can be fully activated, wherein (a) the securing element comprises a snap-in device and the crash lock comprises a mating snap-in device, and during the action of the acceleration force the snap-in device is structured to cooperate with the mating snap-in device for activation of the additional spring, or (b) the securing element is a switch spring, wherein one end of the switch spring cooperates in shape-mated fashion with the crash lock and the other end of the switch spring cooperates in shape-mated fashion with the support frame, in order to provide a first and a second stable position to the securing element.

2. The door handle module according to claim 1, wherein the additional force of the additional spring only acts on the door handle module after activation of the crash lock, in which case a return spring permanently exerts a restoring force on the door handle, in order to also force the handle into the rest position in a non-crash condition.

3. The door handle module according to claim 1, wherein the crash lock also keeps the additional spring activated after the action of the acceleration force, so that door handle is much more difficult to move than in a non-crash condition.

4. The door handle module according to claim 1, wherein the crash lock is spring-loaded by an activation spring, in which case activation of the crash lock can be adjusted by selecting the spring force of activation spring.

5. The door handle module according to claim 1, further comprising an actuating element which mechanically cooperates with the additional spring for door handle and with the crash lock in an active position, wherein the actuating element is mounted on the support frame or on the mechanical coupling unit.

6. Door handle module according to claim 1, wherein the additional spring is arranged between the actuating element and the support frame, and wherein in the active position of crash lock, the actuating element is activated by a driver on the mechanical coupling unit or the additional spring is arranged between the actuating element and the mechanical coupling unit, and wherein in the active position of the crash lock, the actuating element is activated by a stop on crash lock.

7. The door handle module according to claim 1, wherein the crash lock is mounted to pivot or rotate on the support frame or on the mechanical coupling unit and has a recess through which an actuating element can be moved in a non-crash condition.

8. Door handle module according to claim 1, wherein the crash lock has two active positions in order to secure the door handle against an acceleration force from at least two different effect directions, a deactive position of the crash lock being provided between the two active positions.

9. Door handle module according to claim 1, wherein a second crash lock is provided, which secures the door handle in shape-mated fashion during the action of an acceleration force in the rest position.

10. Door handle module according to claim 1, wherein the additional spring is configured with the actuating element in one part as combined part, which is arranged on the coupling unit.

11. The door handle module according to claim 1, wherein the securing element has a first stable position and a second stable position, and wherein during the action of the acceleration force the stable position changes from the first stable position to the second stable position, and thereby holds the additional spring activated.

12. The door handle module according to claim 1, wherein the additional spring is deactivated by transferring the securing element to its normal position.

13. A method for securing a door handle module, comprising:

mounting a door handle to move in a support frame for an opening of a door or hatch by a user, the door handle having at least one rest position and one working position, transferring a movement of the door handle to a lock from the rest position to the working position, through a mechanical coupling unit, preventing movement of the door handle and/or coupling unit with a crash lock during action of an acceleration force so that activation of the lock is avoided, activating an additional spring by the crash lock, during the action of the acceleration force, the additional spring exerting a spring force in the form of an additional force on the moving door handle, in order to force the door handle into the at least one rest position, wherein the crash lock remains activated after a first activation, and the door handle can be fully activated, wherein the door handle module comprises:

a securing element, and the additional spring, wherein the crash lock engages during the action of an acceleration force so that activation of the lock is avoided, wherein (a) the securing element comprises a snap-in device and the crash lock comprises a mating snap-in device, and during the action of the acceleration force the snap-in device is structured to cooperate with the mating snap-in device for activation of the additional spring, or (b) the securing element is a switch spring, wherein one end of the switch spring cooperates in shape-mated fashion with the crash lock and the other end of the switch spring cooperates in shape-mated fashion with the support frame, in order to provide a first and a second stable position to the securing element.

14. A door handle module for a vehicle, comprising:

a door handle, movably mounted in a support frame for the opening of a door or hatch by a user, the door handle having at least one rest position and one working position, a mechanical coupling unit, through which a movement of the door handle from the rest position to the working position can be transferred to a lock, a crash lock, which prevents movement of the door handle and/or coupling unit during action of an acceleration force, so that activation of the lock is avoided, the crash lock further comprising:

a beveled pin, a cam with a cutout arranged to receive the beveled pin, a first spring, and an additional spring;

wherein the crash lock activates the additional spring by slidably engaging the beveled pin with the cam during the action of the acceleration force, in which case the additional spring exerts a spring force in the form of an additional force on moving door handle, in order to force the door handle into the at least one rest position, wherein the crash lock remains activated after a first activation, and the door handle can be fully activated.

15. A method for securing a door handle module, comprising:

mounting a door handle to move in a support frame for an opening of a door or hatch by a user, the door handle having at least one rest position and one working position, transferring a movement of the door handle to a lock from the rest position to the working position, through a mechanical coupling unit, preventing movement of the door handle and/or coupling unit with a crash lock, comprising:

a beveled tipped securing pin, a cam with a cutout arranged to receive the said beveled pin, a first spring, and an additional spring;

the crash lock slidably engages during action of an acceleration force so that activation of the lock is avoided, activating the additional spring by the crash lock, during the action of the acceleration force, the additional spring exerting a spring force in the form of an additional force on the moving door handle, in order to force the door handle into the at least one rest position wherein the crash lock remains activated after a first activation, and the door handle can be fully activated.

* * * * *